US007252176B2

(12) United States Patent
Moore

(10) Patent No.: US 7,252,176 B2
(45) **Date of Patent: *Aug. 7, 2007**

(54) REFLEX-PORTED FOLDED HORN ENCLOSURE

(76) Inventor: Dana A. Moore, 25-157th Pl. SE., Bothell, WA (US) 98012

( * ) Notice: Subject to any disclaimer, the term of this patent is extended or adjusted under 35 U.S.C. 154(b) by 224 days.

This patent is subject to a terminal disclaimer.

(21) Appl. No.: 11/107,453

(22) Filed: Apr. 16, 2005

(65) Prior Publication Data

US 2006/0231328 A1 Oct. 19, 2006

(51) Int. Cl.

| | |
|---|---|
| ***G10K 11/02*** | (2006.01) |
| ***G10K 11/20*** | (2006.01) |
| ***H04R 1/34*** | (2006.01) |
| ***H04R 1/38*** | (2006.01) |

(52) U.S. Cl. ..... 181/199; 181/156; 181/177; 181/152; 181/148; 381/345; 381/337; 381/339; 381/340; 381/341

(58) Field of Classification Search ..... 181/199, 181/156, 177, 152, 148; 381/345, 337, 338, 381/339, 340, 341, 352

See application file for complete search history.

(56) References Cited

U.S. PATENT DOCUMENTS

| | | | | |
|---|---|---|---|---|
| 1,843,524 | A * | 2/1932 | Stenger | 181/159 |
| 3,108,653 | A * | 10/1963 | Valldeperas | 181/150 |
| 4,173,266 | A * | 11/1979 | Pizer et al. | 181/156 |
| 4,210,223 | A * | 7/1980 | Gillum et al. | 181/152 |
| 4,313,032 | A * | 1/1982 | Thomas et al. | 381/341 |
| 5,150,418 | A * | 9/1992 | Honda et al. | 381/349 |
| 5,189,706 | A * | 2/1993 | Saeki | 381/349 |
| 5,359,158 | A * | 10/1994 | Queen | 181/150 |
| 5,525,767 | A * | 6/1996 | Fields | 181/155 |
| 5,637,840 | A * | 6/1997 | Kim | 181/152 |
| 5,804,774 | A * | 9/1998 | Ford et al. | 181/152 |
| 6,144,751 | A * | 11/2000 | Velandia | 381/345 |
| 6,530,451 | B2 * | 3/2003 | Noselli | 181/179 |
| 6,588,544 | B2 * | 7/2003 | Fox | 181/199 |
| 6,744,902 | B2 * | 6/2004 | Proni | 381/386 |
| 2004/0101149 | A1 * | 5/2004 | Furuyama | 381/152 |
| 2005/0217927 | A1 * | 10/2005 | Noselli et al. | 181/191 |
| 2005/0276431 | A1 * | 12/2005 | Moore | 381/340 |

FOREIGN PATENT DOCUMENTS

JP 63229999 A * 9/1988

* cited by examiner

*Primary Examiner*—Lincoln Donovan
*Assistant Examiner*—Jeremy Luks

(57) ABSTRACT

A low frequency exponential/hyperbolic hybrid folded horn enclosure intended for use in proximity with at least one planar surface, such as a floor, ceiling, or wall, with access to the horn throat from the top of the enclosure. The horn is bifurcated at the throat and folds horizontally around a central trapezoid-shaped vertical back chamber which is reflex ported for enhanced low frequency response below the frequency cutoff of the horn. The back chamber outer sides define part of the horn channel, resulting in a relatively simple structure with a small footprint and no void internal space. The throat exponential expansion cross-sectional area is consistently maintained while the proportions of the throat channels are elongated to the height of the enclosure.

20 Claims, 2 Drawing Sheets

REFLEX-PORTED FOLDED HORN ENCLOSURE

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to loudspeaker enclosures of the low frequency exponential folded horn type. More specifically, it relates to front-loaded horn enclosures that are reflex ported and are intended for use in close proximity to at least one planar surface, such as a floor, ceiling or wall.

With the advent of the "Home Theatre" multi-channel market, there is a potential economic avenue for relatively large loudspeakers whose performance approaches the overall sound quality as might be found in commercial theatres. The use of horn loudspeaker enclosures provides the relative quality and the equivalent sound pressure levels that would also be associated with a commercial theatre experience while requiring a lower amount of wattage to achieve it. It is also sonically advantageous in multi-channel systems to use speaker types that are closely matched in efficiency and timbre. Horn loudspeakers capable of low frequency response are typically large in size, and are therefore less apt to be selected for domestic applications where the available floor space is a constraint.

The same issues of enclosure size and efficiency are also applicable to the public address and live music venues where portability and high sound pressure levels are desirable. A popular example of this type of loudspeaker enclosure can be seen in Klipsch, "La Scala", Audio Engineering Society, Preprint No. 372, April, 1965. Whereas the cited example is not reflex ported, it features a bifurcated horn path of relatively simple design with a nominal low frequency cutoff (Fc) of approximately 70 Hz, and the overall size is of the enclosure is relatively compact.

The U.S. Pat. No. 4,138,594 to Klipsch teaches an exponential horn enclosure of relatively small dimensions also suitable for the applications described previously. The cited invention employs a folded exponential unitary horn path and is also not reflex ported. This example features a simple design and additionally presents a relatively small footprint for its performance capabilities, which is substantially similar to the previously cited example. It also features a nominal Fc of approximately 70 Hz.

The above cited prior art examples are known as front-loaded horns, in that the front of the driver feeds directly into the horn throat, and the back chamber for the driver is sealed from the atmosphere. The radiation of sound waves from the back of the driver cone is lost and therefore does not contribute to the overall sound pressure level being produced from the respective horn. The sealed back chamber is configured in volume to equalize the compliance of the back chamber with the reactance at the horn throat.

It is well known in exponential horn loudspeakers that the horn mouth cross-sectional area is determined by the wavelength of the lowest frequency to be produced. For horn loudspeaker enclosures that are intended to operate in proximity to planar surfaces, the cross-sectional area of the horn mouth can be made smaller in area and therefore, the overall dimensions of the horn enclosure can be reduced. It is also well known that the bifurcation of the respective horn at the throat provides for the smallest horn channel dimensions to be employed and for the folds to occur relatively close to the throat, which reduces the possibility of producing standing waves.

The formulas for calculating the values of exponential horns are well known in the art. Such examples can be found in the text "How to Build Speaker Enclosures", by Alexis Badmaieff and Don Davis, Howard W. Sams and Company, Indianapolis, Ind., 13th printing (1978) pages 86 through 91. Additionally, information on reflex (also called phase inversion) porting can be found on pages 54 through 84.

The relative footprint of both of the above cited prior art examples is remarkably compact, however due to the relatively high low frequency cutoff of 70 Hz being employed, they are possibly best suited for vocal reproduction such as in public address use rather than being used in a full-range high fidelity role. It would therefore be advantageous to produce a new enclosure specifically combining an all-horn loaded loudspeaker of high efficiency, capable of a low frequency response suitable for high fidelity use, with a footprint size and overall appearance desirable for domestic applications in addition to public address use.

SUMMARY OF THE INVENTION

It is an object of the present invention to provide substantially the same levels of performance and efficiency as in the previously cited examples while providing access to the horn throat from the top of the cabinet.

An additional object of the invention is to provide, in as much as is possible, a reduction in footprint size when compared to the previously cited prior art examples.

It is a further object of the present invention to provide an increased low frequency response by the incorporation of a reflex or ducted porting mechanism into the back chamber to utilize the radiation from the back of the driver in an additive manner to the reduced output from the horn below its respective low frequency cutoff.

The current invention departs from the previously cited examples of folded horn enclosures in that it provides approximately ⅓ overall reduction of the footprint area and a slightly longer horn pathway. The invention is further set apart from the previous cited prior art examples in that the horn channel proportions are vertically elongated and the back chamber is sized to allow for the use of reflex porting. The present invention is further differentiated as being a bass horn enclosure only, that is, no provision is made in the invention design for the housing or deployment of the midrange and/or high frequency horns, drivers, or associated crossover networks, which are preferably housed in a separate and removable enclosure placed on top of the invention, as is common to the art.

The current invention also provides the advantage of presenting an appropriate elevation for the deployment of midrange and high frequency units, in particular, this aspect is more important for domestic use to achieve a homogenous sound wave front for the average seated listener. It is accepted practice that the height for midrange and high frequency horn units to be placed is approximately 35 to 44 inches in height from the floor for optimum presentation in domestic use. This arrangement is made more beneficial when used in a multi-channel role where it is preferred that the relative height of the high frequency units involved are aligned in the same approximate horizontal plane so as to produce a consistent presentation of the sound field to the seated listeners.

The present invention also has the perceptive advantage of appearing to take up less space than it actually does when viewed from an angle. Due to the common practice of employing speaker "toe-in" for domestic situations, this can be considered a potential aesthetic benefit of the invention. It also fits into a corner slightly deeper than a rectangular or square footprint is capable of due to its particular dimensions.

DESCRIPTION OF THE INVENTION

Figure 1:
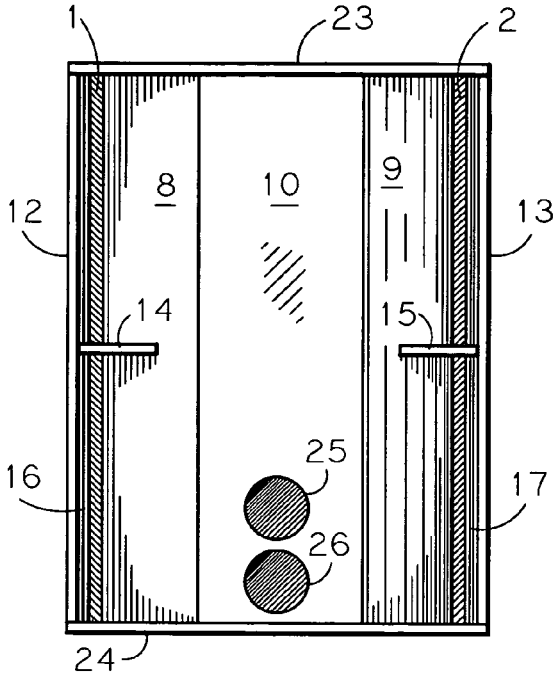
FIG. 1 is a frontal elevation view of the invention.

Referring to FIG. 1, the present invention embodiment is disclosed as seen from the front, where the overall horn mouth cross-sectional area is approximately 4 square feet. The ducted reflex ports 25, 26 contain an equivalent volume of approximately one-half of the overall mouth area. The selected port volume can be altered to accomplish frequency tuning based on the requirements of the application and respective horn driver employed. It is desirable to tune the ports to achieve a response of approximately 32 Hz.

Figure 2:
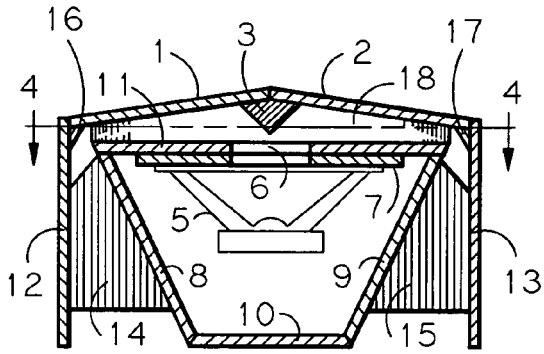
FIG. 2 is a sectional view from line 2-2 of FIG. 3.
Figure 3:
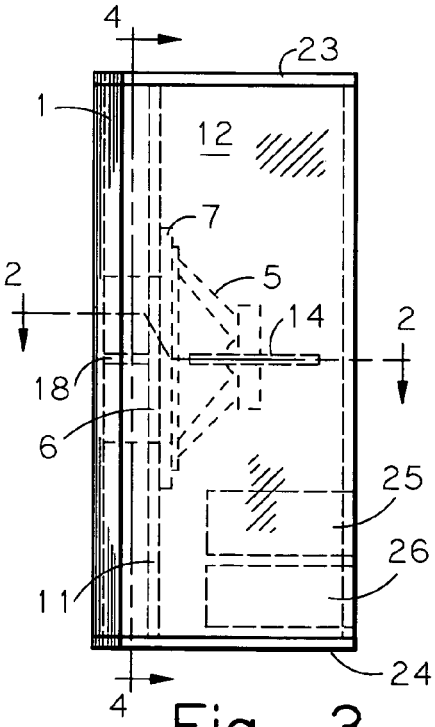
FIG. 3 is a side elevation view showing the orientation of the driver and reflex ports as a reference.

Referring to FIG. 2, the present invention contains a trapezoidal back chamber formed from parts 8, 9, 10, 11 which create a vertically oriented column which is sealed against air leaks except for the top panel 23 access cutout and throat cavity opening 6. The throat cavity opening 6 exists on the back-facing baffle 11 portion of the back chamber and is configured to accept and mount a driver mounting board 7 to the baffle opening 6 in a manner common in the present art. The corner braces 16 and 17 provide an attachment substrate and are intended to turn the waveforms through the folds of the horn channels with a minimum of turbulence.

The optimum volume of the back chamber is approximately 4-½ cubic feet to lower the resonant frequency of the back chamber for use by the porting mechanism. The use of sound absorptive material can be used to increase the virtual volume of the back chamber by as much as 25 percent.

Figure 4:
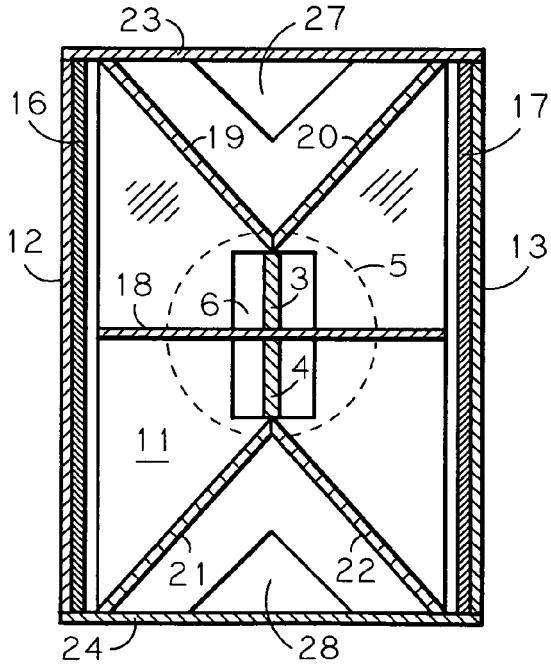
FIG. 4 is a sectional view of the invention from line 4-4 of FIGS. 2 and 3 showing the throat cavity opening and the orientation of the driver as a reference.

Referring to FIG. 4, via the baffle cutouts 27, 28, the triangular spaces formed by the baffle 11 and the throat channel baffle pieces 19, 20, 21, 22 and the rear panels 1, 2 are made part of the total volume of the back chamber and are filled with absorptive material, by which the 4-½ cubic foot optimum volume is achieved. Additional absorptive material can be added to the back chamber to increase the compliance of the back chamber to meet specific applications as needed.

Referring to FIG. 4, the throat cavity opening 6 is sized at 78 square inches, intended for the use of a single 15 inch diameter driver. The vertically oriented horn throat cavity opening 6 is bifurcated via the throat splitting wedges 3, 4 which are intended to turn the waveform 90 degrees into the horizontal exponential channels formed by the throat exponential baffle parts 19, 20, 21, 22 and horizontal brace 18 with the least turbulence possible. The throat splitting wedges 3, 4 also provide an attachment substrate for the rear panels 1, 2 as does the horizontal brace 18, and the throat exponential baffles 19, 20, 21, 22.

The throat exponential baffles 19, 20, 21, 22 and the horizontal brace 18 are arranged in such a manner that in concert with the angled rear cover panels 1, 2 as seen in FIG. 2, the proper cross-sectional area for the expansion rate of 60 Hz, or an exponential expansion area doubling length of 12 inches, is maintained. The exaggerated throat exponential baffles expansion rate is counteracted by the receding angle of the rear panels 1, 2 along the first section of the horn. The function of this design element is to elongate the exponential channels to the full height of the enclosure at the location of the first fold while maintaining the specified exponential expansion rate and associated cross-sectional areas. It is used to change the respective horn channel proportions only and does not introduce a restriction by under-sizing the throat channels. This characteristic feature gives the invention a distinctive footprint and appearance when viewed from the back or sides.

Referring to FIG. 1, the top 23 and bottom 24 panels provide the vertical limits to the horn channels after the folds.

Figure 5:
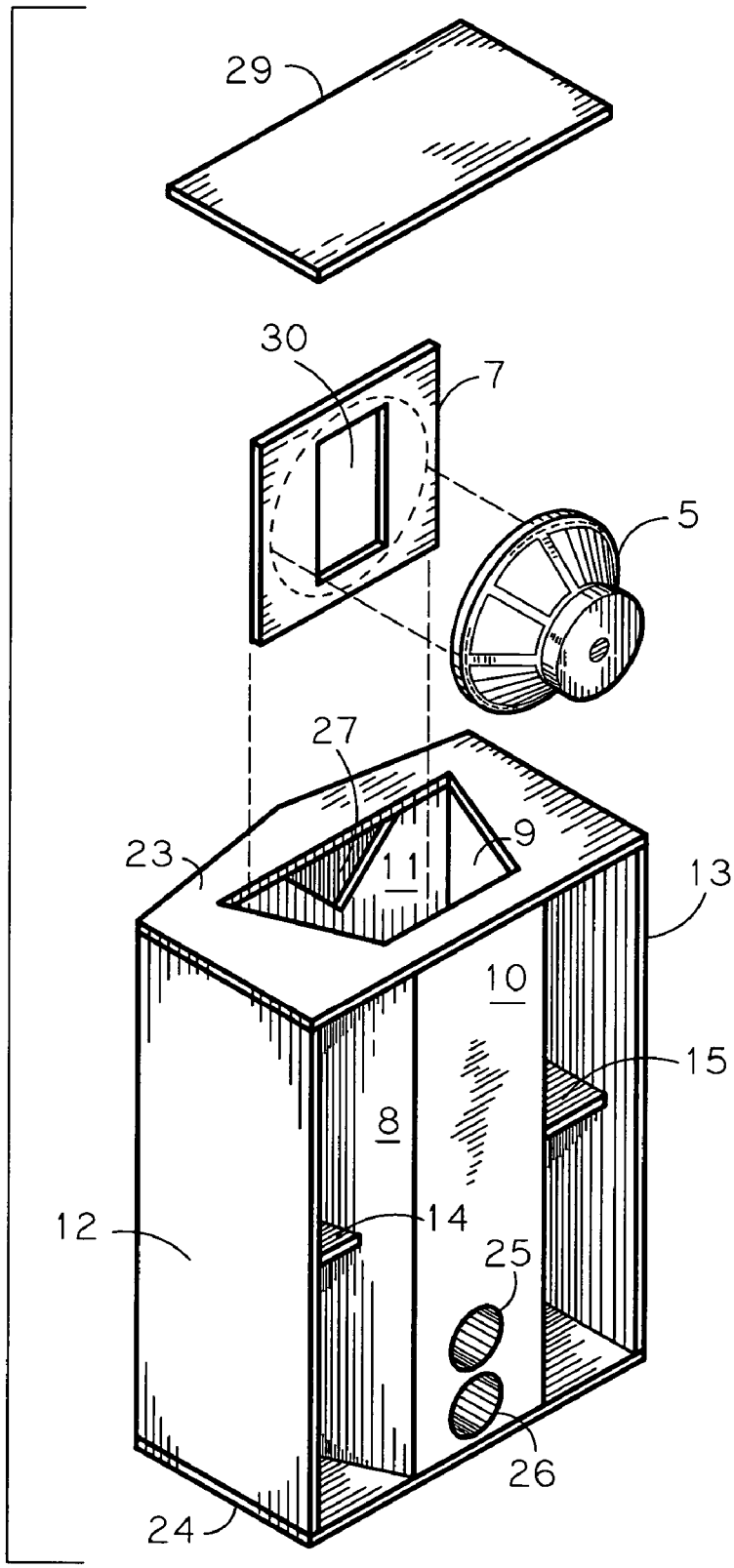
FIG. 5 is an exploded perspective view describing the orientation and nature of the invention.

Referring to FIG. 5, the top panel 23 also features a cutout opening, which provides access to the back chamber.

Referring to FIG. 2, the terminal hyperbolic horn channels are formed by the outer sides of the back chamber 8, 9 and the inner sides of the outer side panels 12, 13. The horizontal side channel braces 14, 15 are for suppressing vibration in the side panels and provide an attachment substrate for the side panels. All of the horn channels in the cabinet are sealed against air leaks.

The terminal channel hyperbolic expansion rate is 100 Hz Fc after the fold, referring to FIG. 2. The combination of the 60 Hz "rubber throat" exponential horn section and the 100 Hz Fc hyperbolic terminal horn section result in an overall Fc of approximately 70 Hz.

The horn mouth occurs at the point of horizontal travel where the enclosure physically ends and the horn itself begins to unload. The overall length of the horn pathway is approximately 26 inches, measured center of channel. The present invention is disclosed as being made of panels of ¾ inch thickness, with the resultant footprint being 25-¼ inches wide by 18 inches deep measured at the peak of the angle, with the sides each being 16 inches in length.

The preferred embodiment of the invention is described in FIG. 5. The driver 5 is attached to the driver mounting board 7 and the driver/board assembly is then mounted to the horn throat opening via the top access opening in the enclosure using means in common use. The back chamber is then sealed from the atmosphere by attaching the access panel 29 to the enclosure top panel 23, as is in common use. The driver mounting board cutout 30 can optionally be used as an acoustic filter when sized smaller than the throat cavity opening 6. The size of the filter cutout to be used is determined by the driver being employed.

Wherein this disclosure depicts one specific type of manufacture, it should not be limited to materials and processes that utilize only straight planar elements, such as plywood and the like. It should also be noted that while straight lines have been used for describing the various horn channels and the splitting wedges, an alternative and perhaps better embodiment could utilize curved or concave elements which would promote an even rotational angle or approximate a true exponential curve more closely. It should be also be noted that while ducted ports are disclosed in the drawings, the porting mechanism should not be limited to the use of ducted ports only; other methods of reflex porting could also be employed, including other phase inverting methodologies, such as passive radiators and the like.

While in accordance with the provisions of the Patent Statutes, the preferred forms and embodiments have been illustrated and described, it will become apparent to those skilled in the art that various changes and modifications may be made without deviating from the inventive concepts set forth above.

I claim:

1. In a horn type loudspeaker for operation in a low frequency range, a cabinet comprised of two back panels abutted together at the proximate sides with each panel arranged in an opposite forwardly increasing angle from the abutment at the rearward plane, an inner panel spaced forwardly of said two rear panels and having a vertically oriented throat opening therein, two inner side panels engaged with the outside edges of said inner panel, converging forwardly of said inner panel to engage at each side of a frontally arranged panel, wherein said converging angles partially define flaring horn sections on either side of the central vertically-oriented air chamber formed therewith, a phase inverting means of said air chamber arranged in said front panel, two outer side panels engaged with the outside edges of said rear panels, spaced from said inner side panels in oppositely disposed spaced planes to form the flaring portions of the terminal horn sections therewith, baffles cooperating with said throat opening and said rear panels to create an equal division of the air column rearward of said throat opening, forming two horizontal horn sections flaring in opposite directions from said throat opening to said terminal horn sections, means for completing said horn sections, and an apertured panel for enabling the sealed engagement of at least one driving unit, mounted forwardly of said throat opening and cooperating therewith, to transmit sound though said throat opening and said horn sections therebeyond.

2. In a horn type loudspeaker as set forth in claim 1, wherein said angle does not exceed 9 degrees as determined by the exponential expansion rate, cabinet height, and distance of travel in said horizontal horn sections.

3. In a horn type loudspeaker as set forth in claim 1, wherein said phase inverting means consists of at least one tunable column of air for the communication of phase-inverted sound waves between said air chamber and the atmosphere.

4. In a horn type loudspeaker as set forth in claim 1, wherein said phase inverting means consists of at least one passive radiator for the propagation of phase-inverted sound waves between said air chamber and the atmosphere.

5. In a horn type loudspeaker as set forth in claim 1, wherein said air chamber being arranged to enclose a volume of air sufficient to lower the low frequency resonance of said driving unit and capacitate said phase inverting means.

6. In a horn type loudspeaker as set forth in claim 1, wherein said completing means includes a top panel in engagement with the ends of said rear and inner and outer panels forming a closure for said opening and said horn sections.

7. In a horn type loudspeaker as set forth in claim 6, wherein said top panel is apertured to provide vertical access to the internal volume of said air chamber and said throat opening therein.

8. In a horn type loudspeaker as set forth in claim 1, wherein said completing means further includes a bottom panel in engagement with the ends of said rear and inner and outer panels, forming a closure for said opening, said chamber, and said horn sections.

9. In a horn loudspeaker intended for operation in proximity to at least one planar surface, a plurality of baffles in relation to form a substantially trapezoidal air chamber, a first aperture in one of said baffles, said baffle being arranged rearwardly, with said aperture being adapted to be closed by at least one driving unit, a second aperture in one of said baffles, said baffle being oppositely and frontally arranged from said first apertured baffle, with said second aperture communicating with a tuned column of air located in said air chamber and arranged to propagate sound waves frontally, a second plurality of baffles defining an air column, which expands at an exponential rate from said aperture and which folds sideways around said air chamber at a hyperbolic rate, and further baffles forming a closure for said air column and said first aperture, completing said air column and said air chamber therewith.

10. In a horn loudspeaker as set forth in claim 9, wherein said second plurality of baffles includes certain baffles arranged to provide vertical expansion from the top and bottom portion of said first aperture to the proximate corners of said first apertured baffle, said certain baffles being adapted along the rearward edges for a receding angle to maintain a predetermined cross-sectional expansion rate along the path of said air column therein.

11. In a horn loudspeaker as set forth in claim 10, wherein said air column is further defined by said second plurality of baffles, wherein two baffles, being rearwardly arranged so as to cooperate in sealed relation with said certain baffles, said air column being symmetrically bifurcated at said first aperture therewith.

12. A horn loudspeaker comprising a trapezoid-shaped columnar air chamber defined by baffles, one of said baffles being apertured and adapted to support at least one driving unit in operating relation to said aperture, additional baffles defining an expanding air column from said aperture and arranged to fold said air column horizontally around said air chamber in opposite directions and further folding said column in a substantially unified direction, wherein two vertical baffles complete the sides of the terminal section of said air column, a top panel, adapted and apertured so as to define a passage to the interior of said air chamber, a bottom panel, and a removable access panel, adapted and arranged so as to seal said air chamber from the atmosphere.

13. A horn loudspeaker as set forth in claim 12, wherein said apertured baffle is arranged rearwardly.

14. A horn loudspeaker as set forth in claim 13, wherein said aperture is of a predetermined size.

15. A horn loudspeaker as set forth in claim 14, wherein said aperture in said baffle is arranged centrally, and consisting of a rectangular shape, is oriented lengthwise vertically therein.

16. A horn loudspeaker as set forth in claim 12, wherein said additional baffles includes certain baffles proximate to said aperture being arranged so as to bifurcate said air column and define the cross-sectional area of said air column proximate to said aperture as being substantially the same as the cross-sectional area of said aperture.

17. A horn loudspeaker as set forth in claim 16, wherein said certain baffles further being arranged so as to elongate said air column to the height of said air chamber proximate to said folds while maintaining the expansion rate cross-sectional area as determined by the horizontal travel of said air column from said aperture to said folds.

18. A horn loudspeaker as set forth in claim 17, wherein said air column follows a substantially exponential pathway from said aperture to said folds.

19. A horn loudspeaker as set forth in claim 18, wherein said air column follows a substantially hyperbolic pathway from said folds through said terminal section.

20. A horn loudspeaker as set forth in claim 12, wherein said baffles further includes a frontally arranged baffle apertured and adapted to reflexively port said air chamber.

* * * * *